US007862453B2

(12) United States Patent
Kouno et al.

(10) Patent No.: US 7,862,453 B2
(45) Date of Patent: Jan. 4, 2011

(54) GOLF CLUB HEAD

(75) Inventors: Masaru Kouno, Kobe (JP); Tomio Kumamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 10 days.

(21) Appl. No.: 12/273,763

(22) Filed: Nov. 19, 2008

(65) Prior Publication Data

US 2009/0139643 A1 Jun. 4, 2009

Related U.S. Application Data

(62) Division of application No. 11/103,555, filed on Apr. 12, 2005, now Pat. No. 7,468,005.

(30) Foreign Application Priority Data

Apr. 28, 2004 (JP) ..... 2004-133936

(51) Int. Cl.
*A63B 53/04* (2006.01)

(52) U.S. Cl. ..... 473/345; 473/348; 473/349

(58) Field of Classification Search ..... 473/324–350
See application file for complete search history.

(56) References Cited

U.S. PATENT DOCUMENTS 6,648,774 B1 * 11/2003 Lee ..... 473/342
6,860,823 B2 * 3/2005 Lee ..... 473/329
6,929,565 B2 * 8/2005 Nakahara et al. ..... 473/345
6,945,876 B2 * 9/2005 Nakahara et al. ..... 473/329
7,037,214 B2 * 5/2006 Nakahara et al. ..... 473/345
7,063,629 B2 * 6/2006 Nakahara et al. ..... 473/345
7,108,612 B2 * 9/2006 Nakahara et al. ..... 473/329
7,128,662 B2 * 10/2006 Kumamoto ..... 473/345
7,147,577 B2 * 12/2006 Nakahara et al. ..... 473/345
7,189,165 B2 * 3/2007 Yamamoto ..... 473/248
7,204,768 B2 * 4/2007 Nakahara et al. ..... 473/329
7,217,199 B2 * 5/2007 Nakahara et al. ..... 473/329
7,252,599 B2 * 8/2007 Hasegawa ..... 473/329

(Continued)

FOREIGN PATENT DOCUMENTS

JP 06086841 A * 3/1994

(Continued)

*Primary Examiner*—Alvin A Hunter
(74) *Attorney, Agent, or Firm*—Birch, Stewart, Kolasch & Birch, LLP

(57) ABSTRACT

The invention prevents a resin member from being broken so as to improve durability. The invention provides a golf club head (1) in which at least a part of a crown portion (4) forming an upper surface of the head is formed by a resin member (FR) made of a fiber reinforced resin in which a fiber is oriented in a matrix resin. The resin member (FR) includes a one-way fiber reinforced resin layer in which the fiber is oriented in one direction, and a fiber intersection lamination portion which is laminated so as to differentiate a direction of the fiber. At least two one-way fiber reinforced resin layers which are adjacent in a thickness direction are intersected at an angle of 30 to 130 degrees of the fiber. Further, a compressive strength of the fiber of the one-way fiber reinforced resin layer which is arranged in an innermost side in the fiber intersection lamination portion is set to be equal to or more than 1.3 GPa.

2 Claims, 13 Drawing Sheets

U.S. PATENT DOCUMENTS

| | | | | |
|---|---|---|---|---|
| 7,261,645 | B2 * | 8/2007 | Oyama | 473/345 |
| 7,281,993 | B2 * | 10/2007 | Oyama | 473/345 |
| 7,297,074 | B2 * | 11/2007 | Kumamoto | 473/345 |
| 7,303,487 | B2 * | 12/2007 | Kumamoto | 473/345 |
| 7,311,614 | B2 * | 12/2007 | Kumamoto | 473/345 |
| 7,455,600 | B2 * | 11/2008 | Imamoto et al. | 473/345 |
| 7,468,005 | B2 * | 12/2008 | Kouno et al. | 473/347 |
| 7,497,788 | B2 * | 3/2009 | Imamoto et al. | 473/335 |
| 7,510,485 | B2 * | 3/2009 | Yamamoto | 473/345 |
| 2005/0026723 | A1 * | 2/2005 | Kumamoto | 473/345 |

FOREIGN PATENT DOCUMENTS

| | | | | |
|---|---|---|---|---|
| JP | 07213655 | A | * | 8/1995 |
| JP | 09000665 | A | * | 1/1997 |
| JP | 2003-111874 | A | | 4/2003 |
| JP | 2003199848 | A | * | 7/2003 |
| JP | 2003210621 | A | * | 7/2003 |
| JP | 2003250933 | A | * | 9/2003 |
| JP | 2004242951 | A | * | 9/2004 |
| JP | 2005-058634 | A | | 3/2005 |
| JP | 2005058748 | A | * | 3/2005 |
| JP | 2005080773 | A | * | 3/2005 |
| JP | 2005124820 | A | * | 5/2005 |
| WO | WO 2004052474 | A1 | * | 6/2004 |

* cited by examiner

Enlarged view of portion X

GOLF CLUB HEAD

CROSS-REFERENCE TO RELATED APPLICATIONS

The present application is a 37 C.F.R. §1.53(b) divisional of U.S. application Ser. No. 11/103,555 filed Apr. 12, 2005 now U.S. Pat. No. 7,468,005, which in turn claims priority on Japanese Application No. 2004-133936 filed Apr. 28, 2004. The entire contents of each of these applications is hereby incorporated by reference.

BACKGROUND OF THE INVENTION

The present invention relates to a golf club head in which a resin member made of a fiber reinforced resin is employed at least in a part of a crown portion.

In recent years, for example, as described in Japanese Published patent application 2003-111874, there has been proposed a so-called compound type golf club head formed by firmly fixing a resin member structuring a part of a crown portion and made of a fiber reinforced resin, and a head main body made of a metal material.

The composite type golf club head as mentioned above can reduce its weight by using a fiber reinforced resin having a small specific gravity. Accordingly, for example, it is possible to enlarge a head volume. Further, the reduced weight can be more distributed in a side portion of a head, for example, a toe or a heel, a back face and the like. These can increase a moment of inertia around a gravity point of the head and increase a depth of center of gravity point. Further, if the fiber reinforce resin is used in the crown portion, it is possible to reduce a weight of an upper portion side of the head, so that it serves for achieving a low gravity point. As mentioned above, in the composite head, it is possible to increase a freedom of designing the weight distribution.

However, in the composite type golf club mentioned above, breakage of the resin member tends to be generated due to an impact at the time of hitting a ball. In order to prevent the resin member from being broken, there can be considered to make a thickness of the resin member large, however, in accordance with this method, it is impossible to obtain a substantial weight reducing effect by the resin member. As mentioned above, in the composite type head, there is a room for further improving durability. Accordingly, in the composite type head, it can be said that an improvement is necessary while paying attention to an angle of orientation of the fiber in the resin member and a strength or an elastic modulus included in a matrix resin.

BRIEF SUMMARY OF THE INVENTION

The present invention is made by taking the actual condition mentioned above into consideration, and an object of the present invention is to provide a golf club head which can inhibit a resin member from being broken in accordance with an impact at the time of hitting a ball for a long time so as to improve durability. The golf club head of the present invention is based on a structure of a resin member so as to include a fiber intersection lamination portion in which one-way fiber reinforced resin layers having the fibers distributed in one direction are laminated in a state of differentiating directions of the fibers, limiting an angle of intersection of the fiber in at least two one-way fiber reinforced resin layers which are adjacent in a thickness direction, and limiting a compressive strength of the fiber of the one-way fiber reinforced resin layer which is arranged in an innermost side in the fiber intersection lamination portion to a fixed value or more.

In this case, the compressive strength of the fiber is determined on the basis of the following procedure. First, there is prepared a test piece made of a fiber reinforced resin obtained by binding a fiber serving as a subject to be measured by a specific resin composition material described in detail below. Further, a compressive strength of the test piece is measured by using a compressing jig shown by ASTMD695 and under a condition of a strain rate 1.27 mm/min. The compressive strength of the fiber is calculated by setting a fiber volume fraction to 60% on the basis of the compressive strength of the test piece.

Further, the specific resin composition material is obtained by mixing the following raw material resin and agitating them for thirty minutes.

Bisphenol A Diglycidyl Ether Resin: 27 weight %

"Trade name: Epicoat 1001 (manufactured by YUKA SHELL EPOXY CO., LTD., Registered Trade Mark)"

Bisphenol A Diglycidyl Ether Resin: 31 weight %

"Trade name: Epicoat 828 (manufactured by YUKA SHELL EPOXY CO., LTD., Registered Trade Mark)"

Phenolic Novolac Polyglycidyl Ether Resin: 31 weight %

"Trade name: Epiclon-N740 (manufactured by Dainippon Ink & Chemicals, Inc., Registered Trade Mark)"

Polyvinyl Formal Resin: 3 weight %

"Trade name: Vinylex K (manufactured by Chisso CO., LTD., Trade Mark)"

Dicyandiamide: 41 weight %

"Trade name: DICY 7 (manufactured by Dainippon Ink & Chemicals, Inc., Registered Trade Mark)"

3,4-dichlorophenyl-1,1-dimethyl urea: 4 weight %

"Trade name: DCMU99 (manufactured by Hodogaya Chemical Co., Ltd, curing agent)"

Next, a resin film obtained by coating the resin composition material on a silicone coating paper is wound around a steel drum which is controlled so as to have a circumference of about 2.7 m and a temperature of 60 to 70° C. The fiber serving as the subject to be measured wound off from a creel is arranged thereon along a circumferential direction via a traverse. Further, the resin film is rearranged thereon and the resin is impregnated in the fiber by pressurizing the resin film while rotating by a roll. Accordingly, it is possible to manufacture a one-way prepreg having a width of 300 mm and a length of 2.7 m. In this case, a fiber weight amount of the prepreg is regulated to 190 g/m$^2$, and a resin percentage content is regulated to 35 weight %.

Further, the one-way prepreg is laminated while aligning in a fiber direction, and is cured for two hours at a temperature of 130° C. and a pressure of 0.3 MPa, whereby a laminated plate having a thickness of 1 mm is formed. A plate for reinforcing the other portions than a broken portion of the test piece is firmly fixed to the laminated plate by an adhesive agent. A thickness of the adhesive layer is set uniform. The test piece is prepared from this laminated plate by being cut out at a thickness of about 1±0.1 mm, a width of 12.7±0.13 mm, a length of 80±0.013 mm, and a length of a gauge portion of 5±0.13 mm, such that the broken portion forms a center.

In the invention, a tensile strength of the fiber in the one-way fiber reinforced resin layer which is arranged in an outermost side May be equal to or more than 3.5 GPa, in said fiber intersection lamination portion.

In this case, with respect to a tensile strength of the fiber, a resin impregnated strand is formed by impregnating an epoxy resin composition material in the fiber corresponding to the subject to be measured, and heating it for thirty minute at 130° C. so as to cure. Further, the tensile strength is determined in accordance with a resin impregnated strand testing method shown in JIS R7601. The epoxy resin composition material is prepared by using the following raw material resin.

Bakelite (Registered Trade Mark): 1000 g (930 weight %)

"Trade name: ERL-4221, manufactured by Union Carbide Co., Ltd."

Boron trifluoride mono-ethylamine (BF3·MEA): 30 g (3 weight %)

Acetone: 40 g (4 weight %)

Also, a golf club head in the invention, the fiber intersection lamination portion May be constituted by at least three one-way fiber reinforced resin layers, and compressive strength of the fiber σc1, σc2, ⋯σcn is an integer equal to or more than 3) of the one-way fiber reinforced resin layers sequentially from that arranged in the inner side, can satisfy the following expressions (1) and (2).

$$\sigma c1 \geqq \sigma c2 \geqq \cdots \geqq \sigma cn \quad (1)$$

$$\sigma c1 > \sigma cn \quad (2)$$

And besides, the fiber intersection lamination portion May be constituted by at least three one-way fiber reinforced resin layers, and tensile strength of the fiber σt1, σt2, ⋯σtn (n is an integer equal to or more than 3) of the one-way fiber reinforced resin layers sequentially from that arranged in the inner side, may satisfy the following expressions (3) and (4).

$$\sigma t1 \geqq \sigma t2 \geqq \cdots \geqq \sigma tn \quad (3)$$

$$\sigma t1 > \sigma tn \quad (4)$$

Additionally, the resin member May include a fiber woven portion in which the fibers extending at least in two directions, at an outer side of said fiber intersection lamination portion.

Since the golf club head in accordance with the present invention has the structure mentioned above, at least a part of a crown portion forming an upper surface of the head is formed by the resin member made of the fiber reinforced resin in which the fiber is oriented in the matrix resin. Accordingly, it is possible to reduce the weight of the upper portion side of the head so as to serve for achieving a low gravity point. Further, the resin member includes the fiber intersection lamination portion, in which the direction of the fiber of the one-way fiber reinforced resin layers is oriented in different direction. Further, at least two one-way fiber reinforced resin layers which are adjacent in the thickness direction are intersected at an angle of 30 to 90 degrees of the fiber. Accordingly, it is possible to increase a strength against a stress in multi directions generated in the resin member at the time of hitting the ball, and it is possible to improve durability by extension.

Further, a large compression stress is applied to an inner side of the resin member provided in the crown portion of the head at the time of hitting the ball. The compressive strength of the fiber of an innermost one-way fiber reinforce resin layer which is arranged in an innermost side in the fiber intersection lamination portion is set to be equal to or more than 1.3 GPa which is larger than the conventional one. Accordingly, it is possible to increase a strength of an inner side of the resin member, and it is possible to effectively prevent the breakage. In this case, since the tensile strength is generated in an outer side of the resin member inversely to the inner side, it is possible to further improve the durability of the resin member by setting the tensile strength of the fiber in the one-way fiber reinforced resin layer which is arranged in the outermost side to be equal to or more than 3.5 GPa.

DETAILED DESCRIPTION OF THE INVENTION

A description will be given below of an embodiment in accordance with the present invention on the basis of the accompanying drawings.

Figure 1:
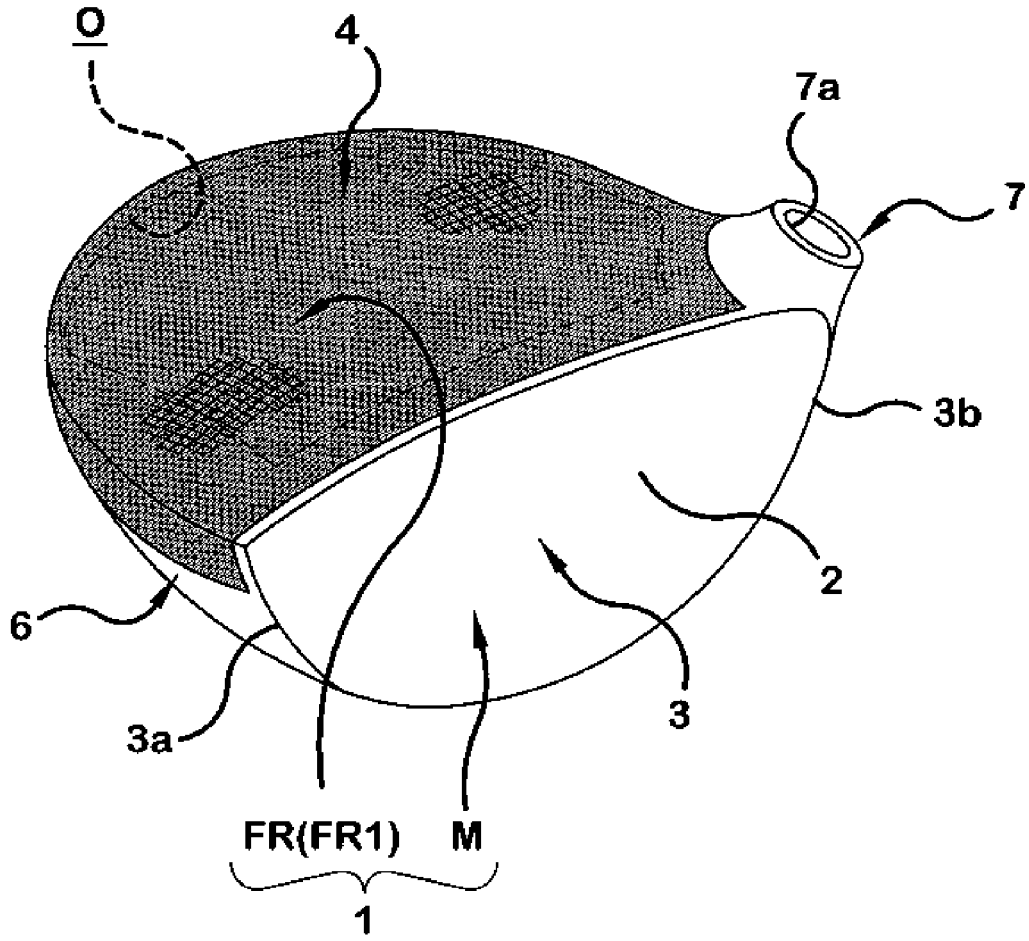
FIG. 1 is a perspective view of a standard condition of a head showing an embodiment in accordance with the present invention.
Figure 2:
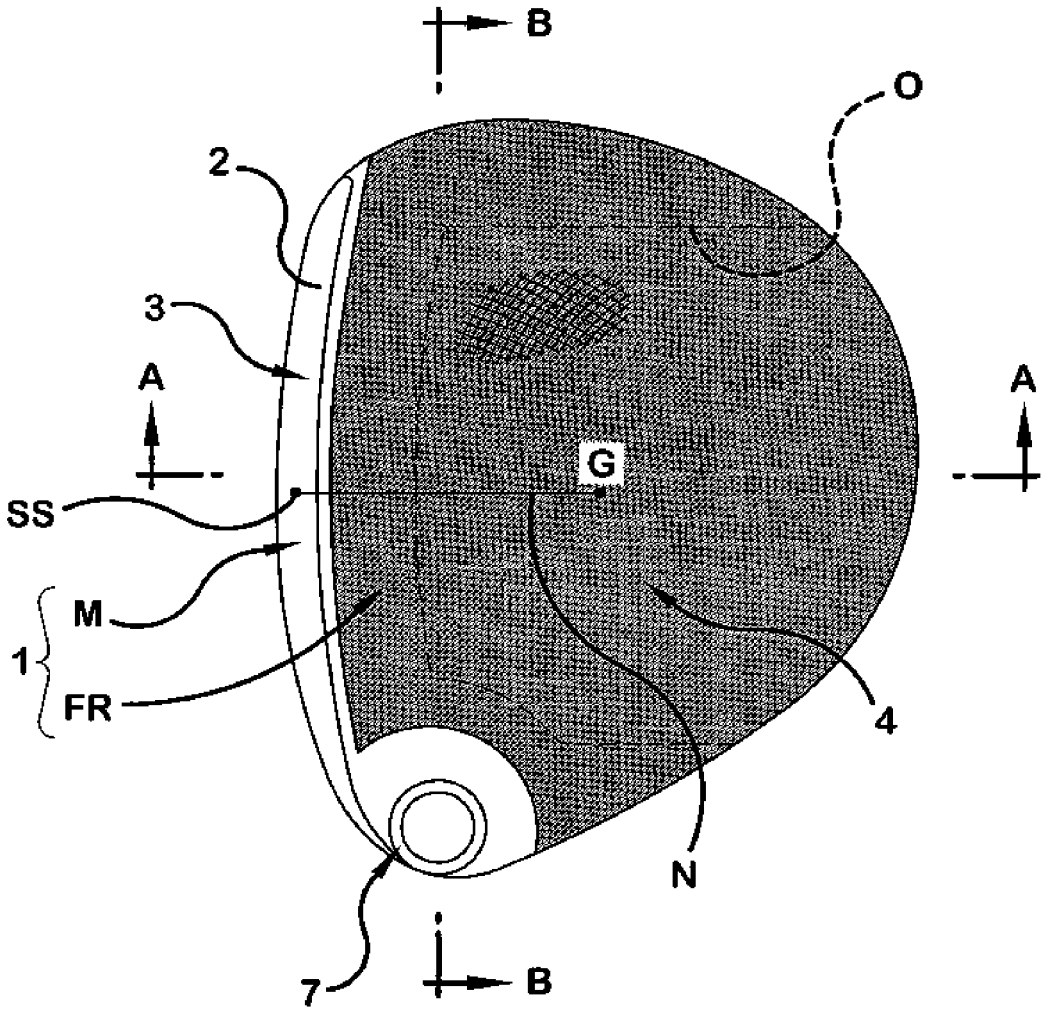
FIG. 2 is a plan view of the same.
Figure 3:
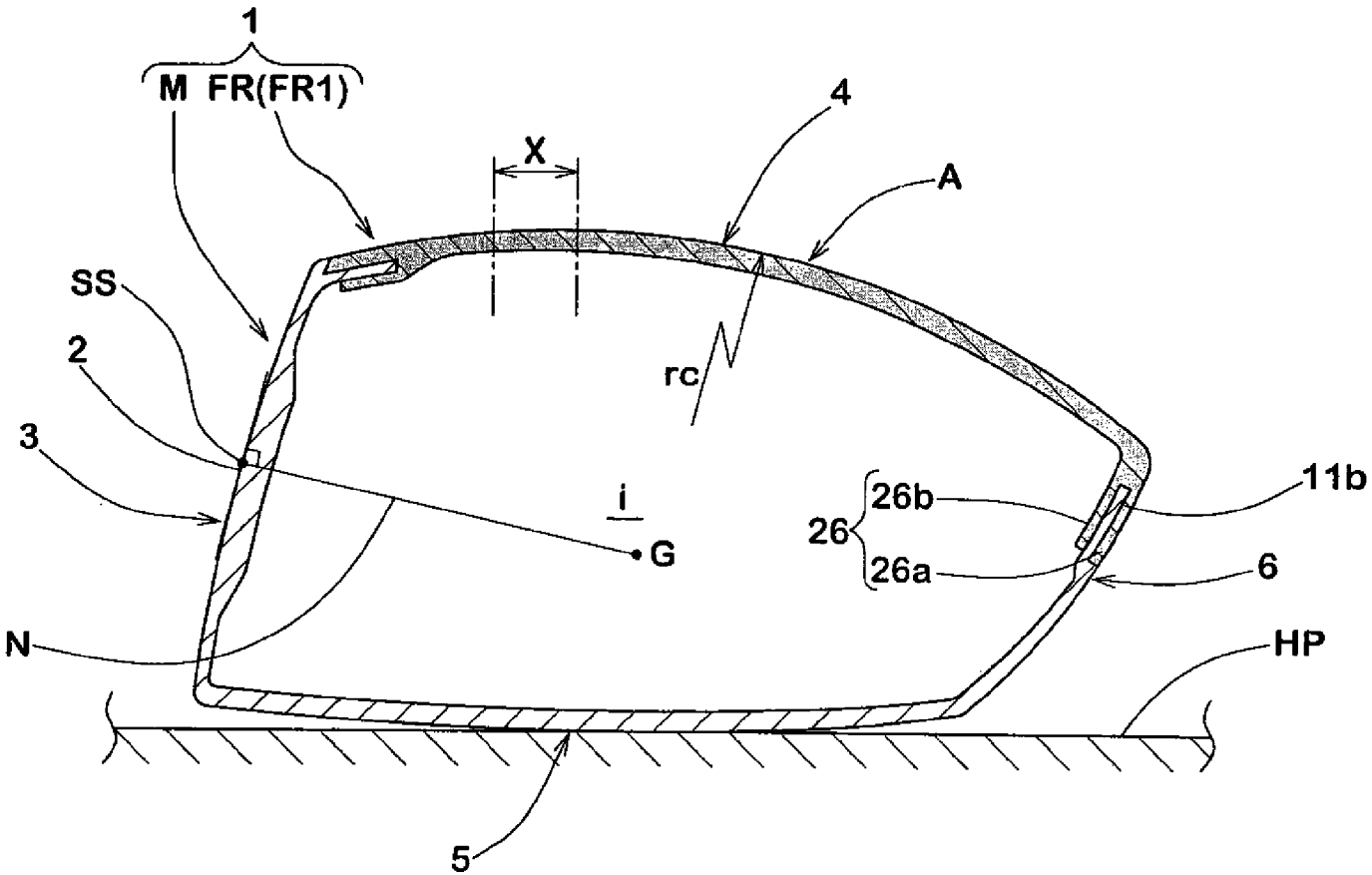
FIG. 3 is an enlarged cross sectional view along a line A-A in FIG. 2.
Figure 4:
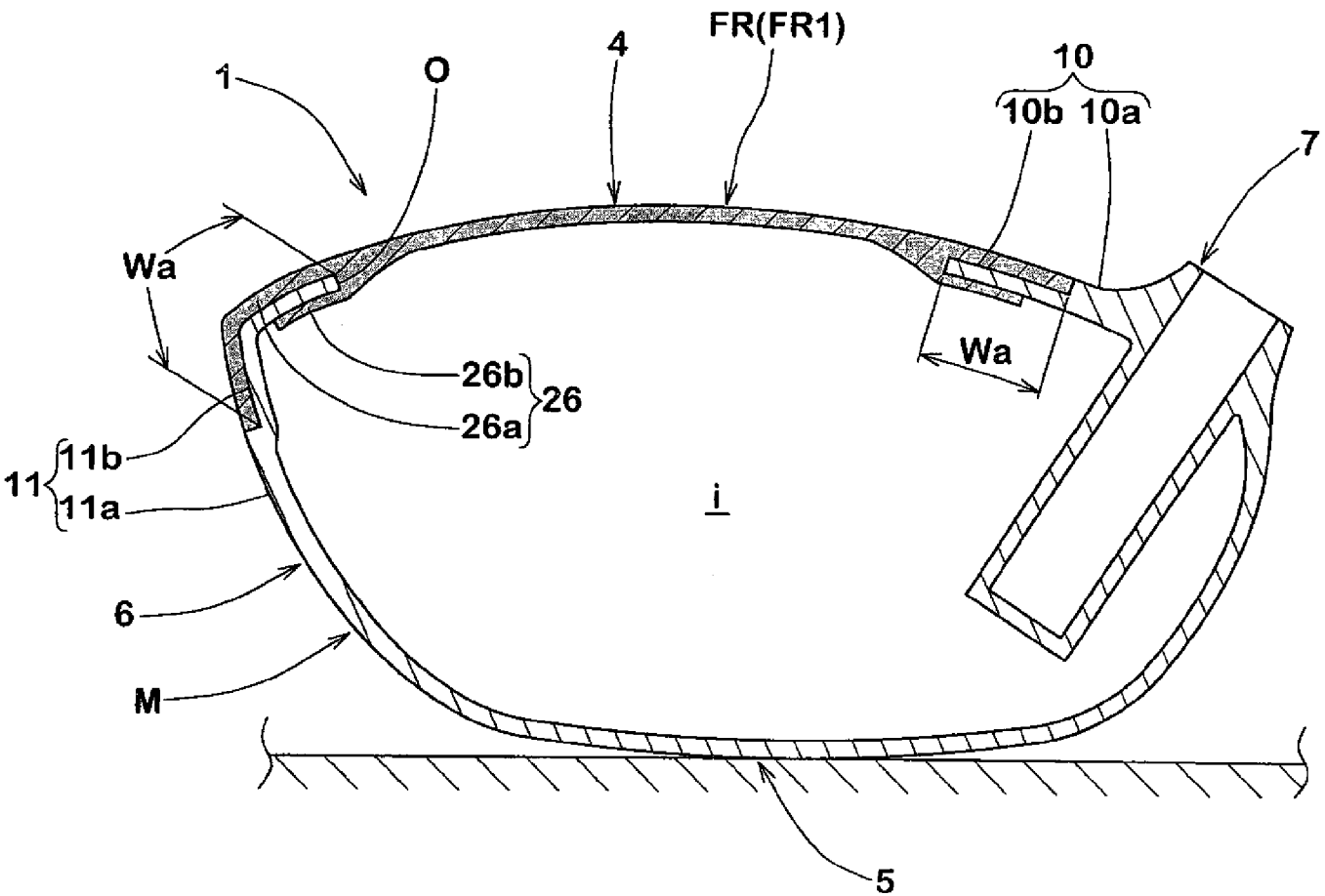
FIG. 4 is an enlarged cross sectional view along a line B-B in FIG. 2.
Figure 5:
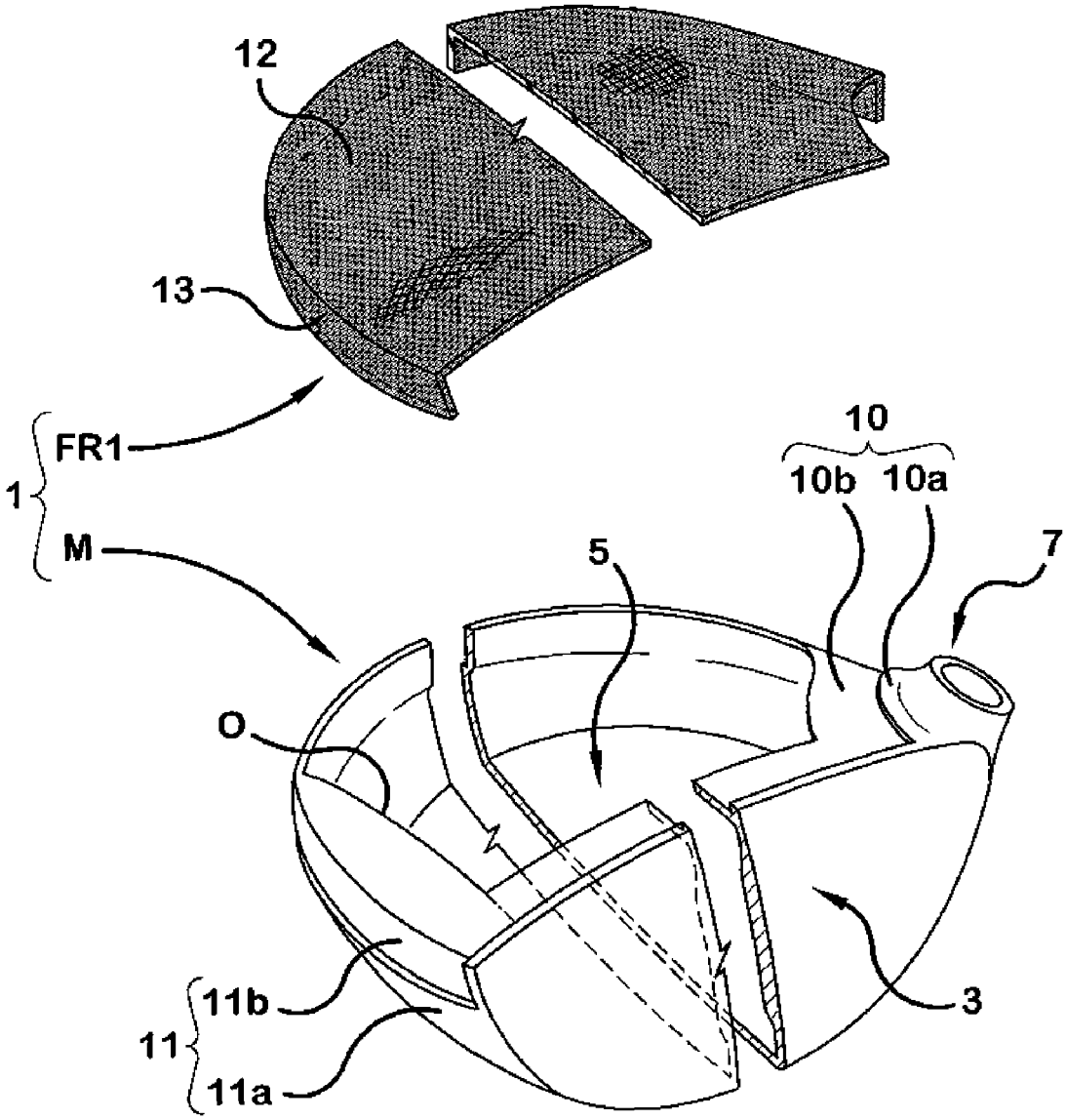
FIG. 5 is an exploded perspective view of the head.

FIG. 1 shows a perspective view of a standard condition in which a golf club head (hereinafter, sometimes refer simply to as a "head") 1 in accordance with the present embodiment is grounded on a horizontal surface while holding the head 1 at prescribed lie angle and loft angle (real loft angle), FIG. 2 shows a plan view of the same, FIG. 3 shows an enlarged cross sectional view along a line A-A in FIG. 2, FIG. 4 shows an enlarged cross sectional view along a line B-B in FIG. 2, and FIG. 5 shows an exploded perspective view of FIG. 1, respectively.

The head 1 in accordance with the present embodiment is provided with a face portion 3 having a face surface 2 corresponding to a surface for hitting a ball, a crown portion 4 connected to the face portion 3 and forming an upper surface of the head, a sole portion 5 connected to the face portion 3 and forming a bottom surface of the head, a side portion 6 joining between the crown portion 4 and the sole portion 5 and extending from a toe 3*a* of the face portion 3 to a heel 3*b* through a back face, and a neck portion 7 provided in a heel side of the crown portion 4 and attached to one end of a shaft (not shown). Further, the head can be structured as a wood type head such as a driver (#1) or a fairway wood having a hollow structure provided with a hollow portion i in an inner portion, and is exemplified as the driver (#1) in the present embodiment.

Further, in the head 1, at least a part of the crown portion 4 is formed by a resin member FR made of a fiber reinforced resin. The head 1 in accordance with the present embodiment is exemplified by a structure which is formed by using a head main body M which is provided with an opening portion O and is made of a metal material, and the resin member FR which is arranged so as to cover the opening portion O and is made of the fiber reinforced resin. The opening portion O is provided in the crown portion 4 in this embodiment by only one, and the resin member FR is constituted by a crown side resin member FR1 covering the opening portion O.

The head main body M is formed, as shown in FIG. 5, so as to include the face portion 3, the sole portion 5, the neck portion 7, a crown edge portion 10 formed around the opening portion O and a side wall portion 11. The head main body M may be manufactured, for example, by previously forming each of portions integrally in accordance with casting or the like. Further, the head main portion M may be manufactured by forming two or more parts in accordance with forging, casting, pressing, rolling or the like and thereafter integrally bonding them in accordance with a welding or the like.

A metal material of the head main body M is not particularly limited, however, can employ, for example, a stainless steel, a maraging steel, a titanium, a titanium alloy, an aluminum alloy, a magnesium alloy, an amorphous alloy or the like, and can especially employ one or two or more of the titanium alloy, the aluminum alloy and the magnesium alloy which have a large specific strength, and particularly preferably employs the titanium alloy.

As shown in FIGS. 4 and 5, the crown edge portion 10 in accordance with the present embodiment includes a crown surface portion 10*a* forming a substantial outer surface portion of the crown portion 4, and a crown receiving portion 10*b* in which a surface is depressed from the crown surface portion 10*a* to the hollow portion i side while having a step. Further, the side wall portion 11 in accordance with the present embodiment includes a side surface portion 11*a* forming a substantial outer surface portion of the side portion 6, and a side receiving portion 11*b* in which a surface is depressed from the side surface portion 11*a* to the hollow portion i side while having a step.

Each of the receiving portions 10*b* and 11*b* is bonded to an inner surface of the resin member FR1 in the crown side and a peripheral edge portion thereof, whereby the crown side resin member FR1 and the head main body M are integrally formed. Further, each of the receiving portions 10*b* and 11*b* absorbs a thickness of the crown side resin member FR1 on the basis of the step mentioned above, and serves for finishing each of the outer surfaces of the resin member FR1 and the head main body M (the crown surface portion 10*a* and the side surface portion 10*b*) in a flush manner.

In this embodiment, the crown receiving portion 10*b* and the side receiving portion 11*b* are connected around the opening portion O. Accordingly, the annularly continuous receiving portion is formed. A width (a length measured along the surface of the receiving portion) Wa of the receiving portions 10*b* and 11*b* measured in a perpendicular direction from an edge of the opening portion O is not particularly limited. However, if the width is too short, a joint area between the head main body M and the crown side resin member FR1 becomes small, so that a bonding strength tends to be lowered. On the contrary, if it is too long, an area of the opening portion O becomes small, so that there is a tendency that a weight saving effect can not be sufficiently obtained. From this point of view, for example, it is desirable that the width Wa is equal to or more than 5.0 mm, and preferably equal to or more than 10.0 mm, and it is desirable that an upper limit is equal to or less than 30.0 mm, more preferably equal to or less than 20.0 mm, and particularly preferably equal to or less than 15.0 mm. In this case, in the present embodiment, the width Wa is exemplified as being changed in each of the portions.

The crown side resin member FR1 is structured by a fiber reinforced resin corresponding to a compound material of a matrix resin and a fiber f.

As the matrix resin R, for example, it is possible to employ a thermosetting resin such as an epoxy resin, a phenol resin, a polyester resin or an unsaturated polyester resin, as well as a thermoplastic resin such as a polycarbonate resin or a nylon resin. In the present embodiment, the epoxy resin is used in view of a cost and a general-purpose property.

As the fiber f mentioned above, for example, it is desirable to employ one or more of a carbon fiber, a graphite fiber, a glass fiber, an alumina fiber, a boron fiber, an aromatic polyester resin fiber, an aramid resin fiber or a PBO resin fiber, or an amorphous fiber or a titanium fiber, and the like, and particularly, the carbon fiber in which a specific gravity is small and a tensile strength is large is preferably employed. The fibers f are structured as a short fiber, a long fiber or both. The long fiber is used in the present embodiment.

An elastic modulus of the fiber f is not particularly limited, however, if it is too small, it is impossible to secure a rigidity of the resin member FR and there is a tendency that the durability is lowered. On the other hand, if it is too large, there is a tendency that the tensile strength is lowered as well as a cost is increased. From this point of view, it is desirable that the elastic modulus of the fiber is equal to or more than 50 GPa, more preferably equal to or more than 100 GPa, further preferably equal to or more than 150 GPa, and particularly preferably equal to or more than 200 GPa. Further, an upper limit thereof is preferably set to be equal to or less than 500 GPa, more preferably equal to or less than 450 GPa, and further preferably equal to or less than 400 GPa. The elastic modulus mentioned above corresponds to an elastic modulus in tension and is a value measured in accordance with a "carbon fiber test method" in JIS R7601.

Further, the crown side resin member FR1 is arranged in a head main body M so as to cover the opening portion O, as shown in FIGS. 1 to 5. Further, in the present embodiment, the resin member FR1 is exemplified as a structure which includes a base portion 12 forming a part of the crown portion 4, and a trailing portion 13 bent from the base portion 12 and forming a part of the side portion 6. Since the crown side resin member FR1 having the shape mentioned above is bonded to each of the crown receiving portion 10*b* and the side receiving portion 11*b* in the peripheral edge of the base portion 12, an adhesive interface is provided in the crown portion 4 and the side portion 6 so as to be diversified, and it is possible to achieve a high adhesive strength against an external force applied from various directions. Since the trailing portion 13 forms a surface which is bent at an angle close to an approximately right angle from the crown receiving portion 10*b*, it is possible to improve the strength.

Figure 6:
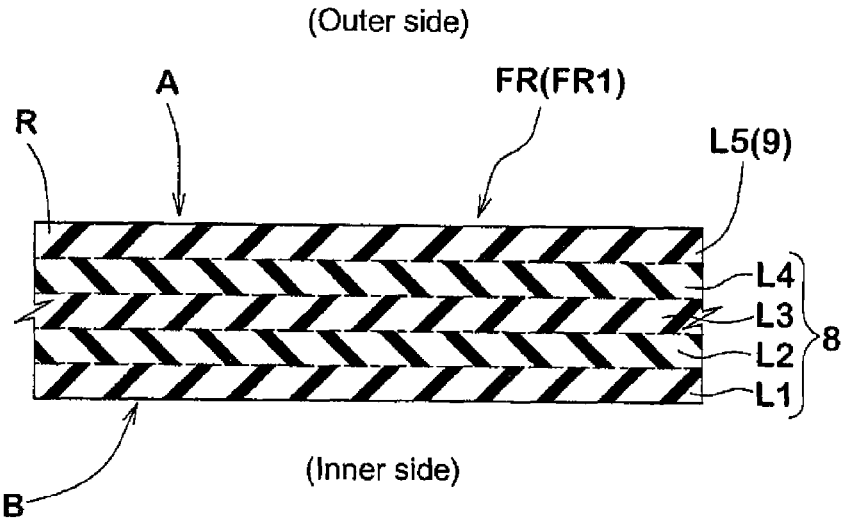
FIG. 6 is an enlarged view of a portion X in FIG. 3.
Figure 7:
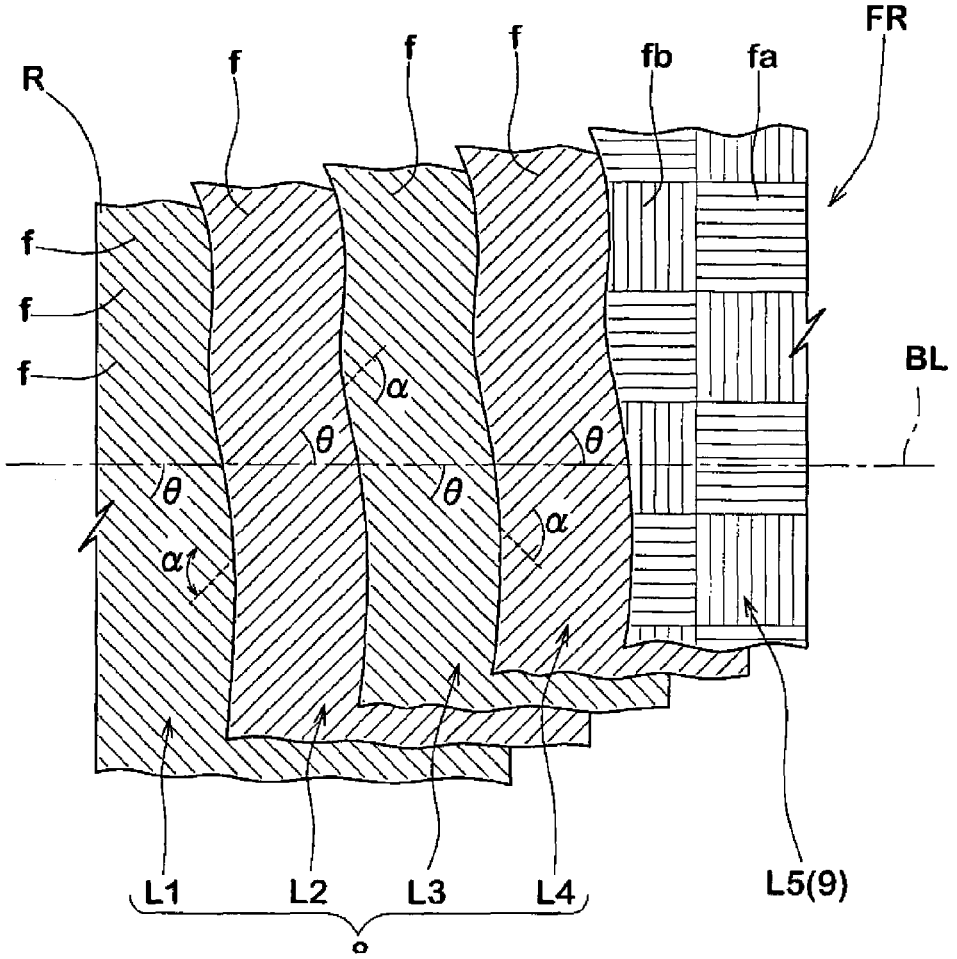
FIG. 7 is a partial exploded plan view of FIG. 6.

FIG. 6 shows an enlarged cross sectional view of the crown side resin member FR1 corresponding to an enlarged view of a portion X in FIG. 3. In this drawing, only a matrix resin R is drawn and a reinforcing fiber is omitted. Further, FIG. 7 shows a plan view in which a part of FIG. 6 is broken, for the purpose of easily understanding a laminated state of the layers.

The resin member FR1 in the crown side is exemplified by a structure constituted by five fiber reinforced resin layers having different fiber orientation directions in accordance with the present embodiment. Specifically speaking, the resin member FR1 in the crown side in accordance with this embodiment is structured such as to include a fiber intersection lamination portion 8 in which four one-way fiber reinforced resin layers L1 to L4 are laminated, and a fiber woven portion 9 constituted by one intersection fiber reinforced resin layer L5 arranged in an outer side thereof. The outer side fiber woven portion 9 forms an outer surface A of the resin member FR1. Including a plurality of fiber reinforced resin layers having the different fiber orientation directions as mentioned above serves for uniformly dispersing the stress with respect to a thickness direction of the resin member FR1. Accordingly, it is desirable that the fiber intersection lamination portion 8 is preferably constituted by at least three or more one-way fiber reinforced resin layers.

Each of the one-way fiber reinforced resin layers L1 to L4 mentioned above is structured such that the fiber f is oriented in the matrix resin R in one direction. Accordingly, for example, a reinforced resin layer having a woven fabric fiber obtained by alternately weaving warp or warps and weft or wefts is not included in the one-way fiber reinforced resin layer. Further, as shown in FIG. 7, at least two one-way fiber reinforced resin layers which are adjacent in the thickness direction are structured such that the respective fibers f are intersected at an angle $\alpha$ of 30 degrees to 90 degrees in the fiber intersection lamination portion 8. The angle $\alpha$ is a relative angle between the intersecting fibers, and means an acute angle (except 90 degrees).

In the present embodiment, the one-way fiber reinforced resin L1 arranged in the innermost side has a fiber f which is oriented in one direction substantially having an angle of −45 degrees (the angle is set to be positive in a counterclockwise direction) with respect to a base line BL in a head longitudinal direction. In the same manner, the one-way fiber reinforced resin layer L2 overlapped in an outer side thereof has a fiber f which is oriented in a direction in which the angle $\theta$ is 45 degrees, the one-way fiber reinforced resin layer L3 overlapped in further an outer side thereof has a fiber f which is oriented in a direction in which the angle $\theta$ is −45 degrees, and the one-way fiber reinforced resin layer L4 overlapped in further an outer side thereof has a fiber f which is oriented in a direction in which the angle $\theta$ is 45 degrees. Three interlayer boundary surfaces are formed by overlapping four one-way fiber reinforced resin layers L1 to L4. In this case, the base line BL in the head longitudinal direction corresponds to a line segment in which a vertical surface including a vertical line N drawn from a head gravity point G to the face surface 2 intersects the resin member FR1 in a plan view (FIG. 2) in the standard condition.

If the angle $\alpha$ at which the fiber f intersects is less than 30 degrees in the boundary surface of each of the layers, a large strength anisotropy tends to be generated by these two one-way fiber reinforced resin layers. As a result, in the case that the stress is applied in the direction having a low strength, there is a risk that the resin member FR1 is broken. Particularly preferably, it is desirable that the angle $\alpha$ is set from 60 to 90 degrees, further preferably from 80 to 90 degrees, most preferably from 85 to 90 degrees. In the present embodiment, there is shown a particularly preferable aspect that the angles $\alpha$ in all the boundary surfaces are substantially 90 degrees.

Further, in the fiber intersection lamination portion 8, it is sufficient that the fibers of at least two one-way fiber reinforced resin layers intersect at the angle $\alpha$ mentioned above. As in the present embodiment, the angle $\alpha$ mentioned above is preferably satisfied in all the one-way fiber reinforced resin layers which are adjacent in the thickness direction.

Figure 9A:
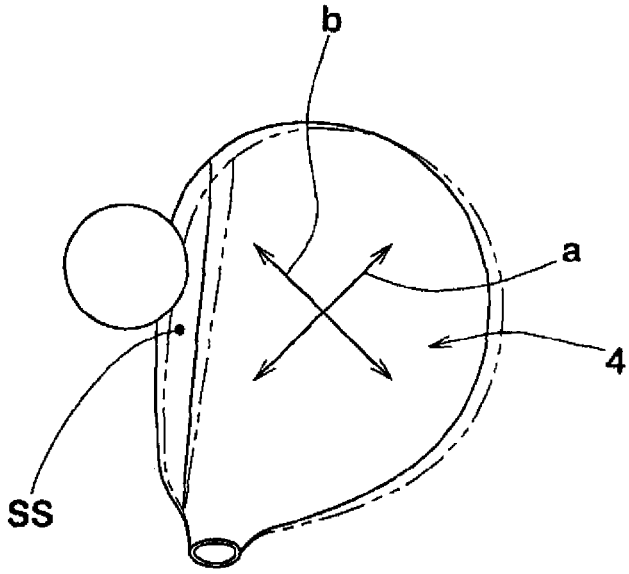
FIGS. 9(A) and 9(B) are plan skeleton views showing a direction of a main stress applied to a crown portion at the time of hitting a ball.

Further, the angle $\theta$ formed between each of the fibers f in the one-way fiber reinforced resin layers L1 to L4 and the base line BL in the head longitudinal direction is not particularly limited. For example, in the case of a general amateur golfer, it is hard to correctly hit a golf ball at a sweet spot SS of the face surface 2 (a point at which the vertical line N intersects the face surface 2 as shown in FIG. 2), and the amateur golfer generally hit the ball at a position which is deflected from the sweet spot SS to a toe or heel (not shown) side as shown in FIG. 9(A).

At this time, a torsional deformation is generated crown portion 4 of the head 1. The deformation mentioned above mainly applies inclined stresses a and b as shown in FIG. 9(A) with respect to the base line BL in the head longitudinal direction to the resin member FR1. Accordingly, in the case of aiming at the amateur golfer, it is preferable to alternately arrange the angle $\theta$ of the one-way fiber reinforced resin layer to 45 degrees and −45 degrees as in the present embodiment so as to improve the strength against the main stress direction. Further, the head 1 mentioned above serves for inhibiting the torsional deformation mentioned above, restricting the direction change of the face surface 2 to the minimum, and stabilizing the directionality of the hit ball.

Figure 8:
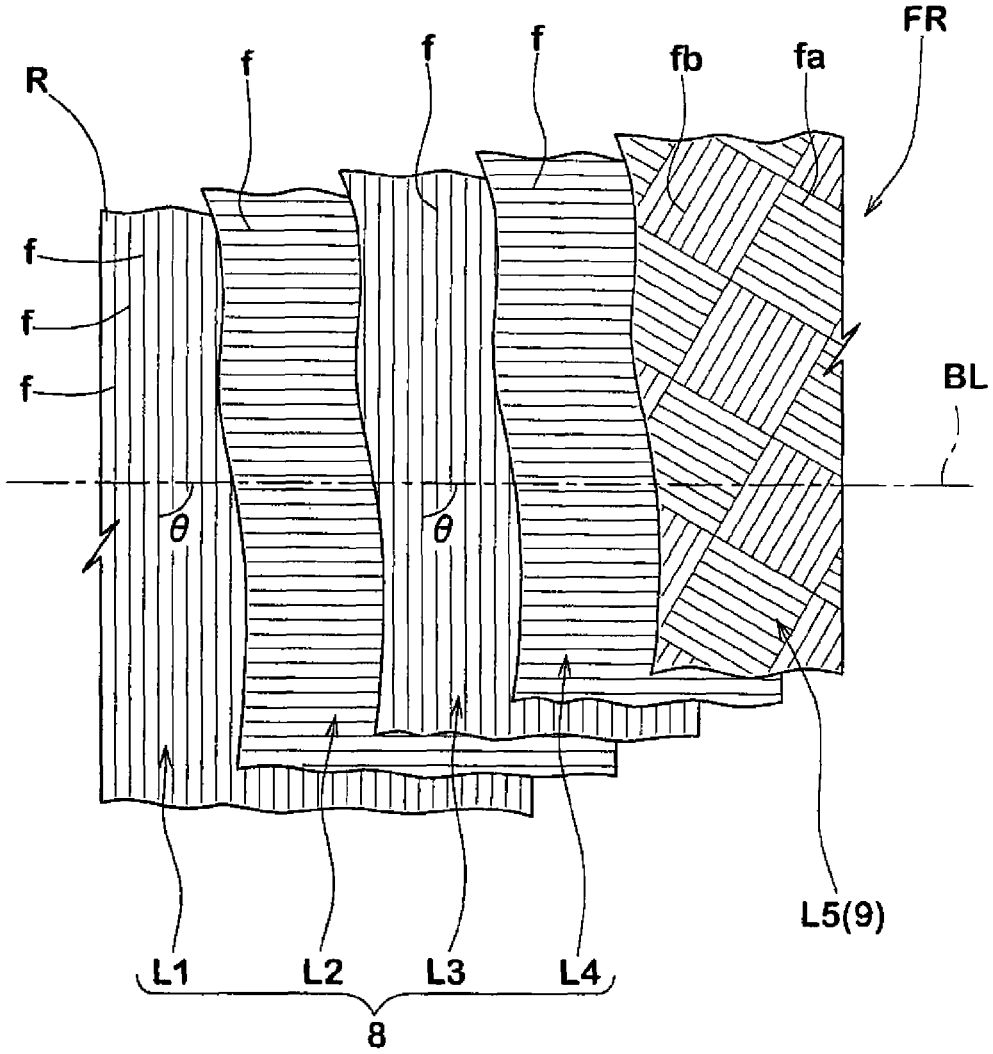
FIG. 8 is a partial exploded plan view of FIG. 6 showing another embodiment.
Figure 9B:
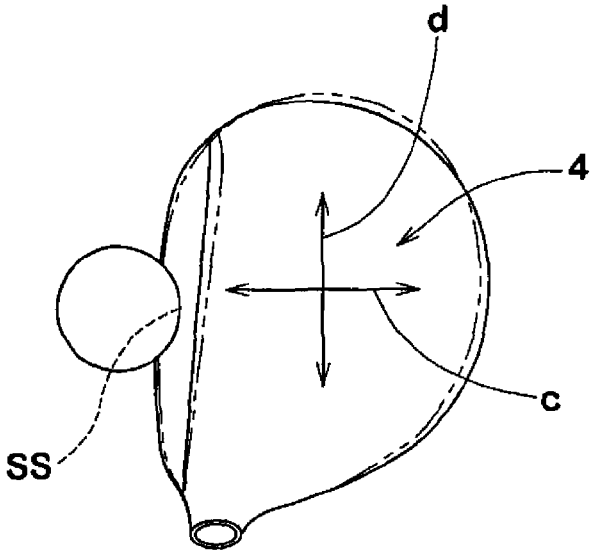

On the other hand, as for professional and senior golfers, as shown in FIG. 9(B), in most cases, the ball is accurately hit at the sweet spot SS, or the position near the sweet spot SS. At this time, in the crown portion 4 of the head 1, in a direction of a plain surface, there is mainly generated a stress c in a direction in parallel to the base line BL of the head longitudinal direction, and a stress d in a perpendicular direction thereto. Accordingly, in the case of the head aiming at the senior golfer, as shown in FIG. 8, it is effective to mainly improve the strength against the stress direction by alternately arranging the angle $\theta$ of the one-way fiber reinforced resin layer at 0 degrees and 90 degrees. Further, in the head 1 as mentioned above, a restoring force is larger after the resin member FR1 arranged in the crown portion 4 is deflected. This serves for increasing a repulsion property of the face portion and hitting a ball longer away. In view of increasing the repulsion property, it is preferable to arrange one or more one-way fiber reinforced resin layer having the angle $\theta$ of −10 to 10 degrees, more preferable to arrange two or more layers. In this case, if the number of the one-way fiber reinforced resin layer having the angle $\theta$ of −10 to 10 degrees is too large, the head becomes too heavy and a cost increase tends to be caused. Accordingly, an upper limit of the number of the one-way fiber reinforced resin layer having the angle $\theta$ of −10 to 10 degrees is set to be equal to or less than five, more preferably equal to or less than four, and particularly preferably equal to or less than three.

Further, the angles $\theta$ and $\alpha$ mentioned above may employ any values as far as the angles are satisfied at an optional position on the base line BL in the head longitudinal direction of the resin member FR1. Because a greatest stress tends to be generated in this portion. It is not necessary that the angle $\theta$ of the fiber f is exactly an angle just corresponding to the numeric value, and it is sufficient that the angle is a substantial value obtained by taking a manufacturing error and a dispersion of the material into consideration. For example, the angle $\theta$ of the fiber f can allow at least a dispersion of −10 to +10 degrees (that is, ±10 degrees), more preferably a dispersion of −5 to +5 degrees (that is, ±5 degrees).

Further, the fiber woven portion 9 arranged in an outer side of the fiber intersection lamination portion 8 is structured, as shown in FIG. 7, by one intersection fiber reinforced resin layer L5 having at least fibers fa and fb extending in two directions. In an example shown in FIG. 7, the fibers fa and fb are exemplified by structures which have two directions substantially forming 0 degrees and 90 degrees with respect to the base line BL in the head longitudinal direction, and are woven in a plain weave shape by setting the fibers in the respective directions to the warp and weft. A weaving method can employ various methods, for example, a sateen weave, a twill weave and the like in addition to the plain weave. Further, the fiber may be woven in a plain three-axis weave or the like as far as two or more fibers in different directions are provided. However, it is preferable to define the direction in this case such that the angle of intersection of the fiber is uniform. The intersection fiber reinforced resin layer L5 mentioned above serves for uniformly dispersing the stress generated at the time of hitting the ball. In particularly preferable, it is desirable to differentiate the angle of orientation of the fibers fa and fb from the angle of each of the fibers in the fiber intersection lamination portion 8.

Figure 10A:
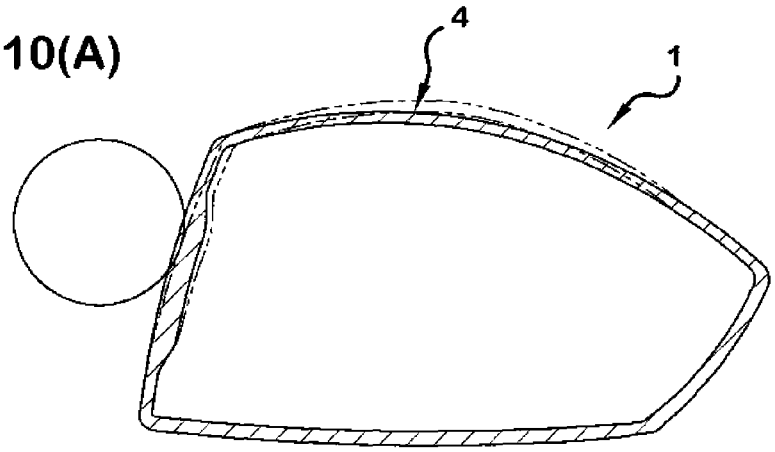
FIG. 10(A) is a cross sectional view rhetorically showing a deformed state of the head at the time of hitting the ball.
Figure 10B:
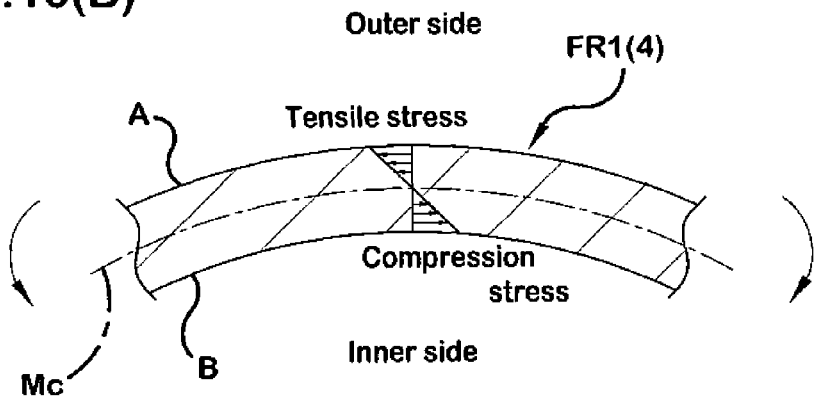
FIG. 10(B) is a partial enlarged view of a resin member in a crown side thereof.

In this case, the base portion 12 of the resin member FR1 in the crown side is smoothly curved so as to protrude to an upper side of the head in the cross section in the base line BL in the head longitudinal direction shown in FIG. 3, and in accordance with one example, a radius of curvature rc of the outer surface A thereof is set to about 55 to 130 mm. As shown in FIG. 10(A) and FIG. 10(B) showing a part thereof by a rhetorically enlarging manner, in the resin member FR1 in the crown side, a deflection (a bending deformation) protruding toward the outer side of the head is generated at the time of hitting the ball, on the basis of the curved shape as mentioned above. The deformation mentioned above applies a compression stress to an inner side of a neutral line Mc of the bending of the resin member FR1 and applies a tensile stress to an outer side thereof, respectively, and a magnitude of each of them becomes maximum in each of the surfaces A and B.

On the other hand, in the fiber f of the fiber reinforced resin, the compressive strength is smaller in comparison with the tensile strength in the axial direction. Accordingly, it is possible to estimate that any breakage is generated in most of the conventional resin members due to the compression stress applied to the inner side thereof. In the head 1 in accordance with the present invention, the compressive strength of the one-way fiber reinforced resin layer L1 which is arranged in the innermost side in the fiber intersection lamination portion 8 is set to be equal to or more than 1.3 GPa which is larger than the conventional one. Accordingly, it is possible to effectively prevent the resin member FR1 in the crown side from being broken. Further, an elastic energy stored in the resin member FR1 in the crown side deflected at the time of hitting the ball generates a great kinetic energy pushing back the face portion 3 at the time of restoring the deflection, by increasing the compressive strength in the inner side of the resin member FR1. This serves for improving a repulsing performance of the head 1.

In the case that the compression strength of the resin member FR1 in the crown side is less than 1.3 GPa, it is impossible to sufficiently intend to improve the strength. As a particularly preferable aspect, it is desirable that the compressive strength is equal to or more than 1.5 GPa, and more preferably equal to or more than 1.6 GPa. In this case, since the larger compressive strength is preferable, an upper limit thereof is not particularly limited, however, can be practically set to about 1.8 GPa.

Further, in the fiber intersection lamination portion 8, an entire thereof can be structured by the one-way fiber reinforced resin layer having the same compressive strength, however, the compression stress of the resin member FR1 in the crown side generated at the time of hitting the ball is in proportion to a distance from a bending neutral line Mc as shown in FIG. 10(B), becomes maximum in an inner side surface B and becomes smaller toward an outer side. Accordingly, it is desirable to make the compressive strength of the fiber of each of the one-way fiber reinforced resin layers in the fiber intersection lamination portion 8 larger toward the inner side in correspondence to the internal stress state of the resin member FR1 mentioned above. Therefore, it is possible to use a low cost material in which the compressive strength is relatively lowered, in the other one-way fiber reinforced resin layer than the innermost side, and it is possible to improve durability while maintaining a product cost.

Specifically, on the assumption that the compressive strength of the fiber of the one-way fiber reinforced resin layer in the fiber intersection lamination portion 8 is sequentially set to $\sigma c1$, $\sigma c2$, $\sigma cn$ (in this case, n is an integer equal to or more than 3) from that arranged in the inner side, it is desirable to satisfy the following expressions (1) and (2).

$$\sigma c1 \geqq \sigma c2 \geqq \sigma cn \quad (1)$$

$$\sigma c1 > \sigma cn \quad (2)$$

Particularly, it is desirable that the expression (1) is the following expression (1)', and the compressive strength is differentiated in each of the layers.

$$\sigma c1 > \sigma c2 > \sigma cn \quad (1)'$$

Further, in these cases, it is desirable that a difference ($\sigma c1-\sigma cn$) between the compressive strength $\sigma c1$ of the fiber f in the innermost side one-way fiber reinforced resin layer L1, and the smallest compressive strength $\sigma cn$ in the other one-way fiber reinforced resin layer is preferably equal to or more than 0.20 GPa, more preferably equal to or more than 0.25 GPa, and further preferably equal to or more than 0.30 GPa, and upper limit thereof is preferably equal to or less than 0.60 GPa, more preferably equal to or less than 0.55 GPa, and further preferably equal to or less than 0.50 GPa. If the difference is less than 0.20 GPa, it is impossible to apply a sufficient strength difference, and it is hard to achieve the cost reduction. On the contrary, if it is more than 0.60 GPa, the strength difference becomes too large, and the breakage or the like tends to be generated in the other one-way fiber reinforced resin layer.

Further, the tensile stress is generated in the outer side of the resin member FR1 in the crown side at the time of hitting the ball, as mentioned above. The tensile strength of the fiber f is larger in comparison with the compressive strength, however, it is possible to further increase the durability of the resin member FR1 in the crown side by inhibiting the value. Accordingly, it is desirable that the tensile strength of the one-way fiber reinforced resin layer L4 arranged in the outermost side is set to be equal to or more than 3.5 GPa, more preferably equal to or more than 4.0 GPa, and further preferably equal to or more than 5.0 GPa, preferably in the fiber intersection lamination portion 8 mentioned above. In this case, since the larger tensile strength is preferable, an upper limit thereof is not particularly limited, however, can be set practically to about 6.0 GPa.

Further, in the fiber intersection laminated portion 8, an entire thereof can be structured by the one-way fiber reinforced resin layer having the same tensile strength. However, the tensile stress of the resin member FR1 in the crown side generated at the time of hitting the ball is in proportion to the distance from the bending neutral line Mc in the same manner as the compression stress, becomes largest in the outer surface A, and becomes smaller toward the inner side. Accordingly, it is desirable to make the tensile strength of the fiber in each of the one-way fiber reinforced resin layers of the fiber intersection lamination portion 8 larger toward the outer side, in correspondence to the internal stress state of the resin member FR1 mentioned above. Therefore, it is possible to improve the durability while maintaining the product cost in the same manner as mentioned above.

Specifically speaking, on the assumption that the tensile strength of the fiber of the one-way fiber reinforced resin layer in the fiber intersection lamination portion 8 is sequentially set to σt1, σt2, ⋯σtn (in this case, n is an integer equal to or more than 3) from that arranged in the inner side, it is desirable to satisfy the following expressions (3) and (4).

$$\sigma t1 \geqq \sigma t2 \geqq \cdots \geqq \sigma tn \quad (3)$$

$$\sigma t1 > \sigma tn \quad (4)$$

In particularly preferable, it is desirable that the expression (3) is expressed by the following expression (3)' and the tensile strength is differentiated in each of the layers.

$$\sigma t1 > \sigma t2 > \cdots \sigma tn \quad (3)'$$

Further, in these cases, it is desirable that a difference (σtn−σt1) between the tensile strength σtn of the fiber f in the outermost side one-way fiber reinforced resin layer L1, and the smallest tensile strength σt1 in the other one-way fiber reinforced resin layer is preferably equal to or more than 0.20 GPa, more preferably equal to or more than 0.25 GPa, and further preferably equal to or more than 0.30 GPa, and upper limit thereof is preferably equal to or less than 0.60 GPa, more preferably equal to or less than 0.55 GPa, and further preferably equal to or less than 0.50 GPa. If the difference is less than 0.20 GPa, it is impossible to apply a sufficient strength difference, and it is hard to achieve the cost reduction. On the contrary, if it is more than 0.60 GPa, the strength difference becomes too large, and the breakage or the like tends to be generated in the other one-way fiber reinforced resin layer.

Further, the resin member FR1 in the crown side intends to achieve a weight saving (a thickness saving) while securing a rigidity required for the gold club head. Accordingly, on the assumption that the elastic modulus (the elastic modulus in tension) of the fiber of the one-way fiber reinforced resin layer in the fiber intersection lamination portion 8 is sequentially set to E1, E2, . . . En (in this case, n is an integer, or integral number equal to or more than 3) from that arranged in the inner side, it is desirable to satisfy the following expressions (5) and (6).

$$E1 \leqq E2 \leqq \ldots \leqq En \quad (5)$$

$$E1 < En \quad (6)$$

In particularly preferable, it is desirable that the expression (5) is expressed by the following expression (5)', and the elastic modulus in tension is differentiated in each of the layers.

$$E1 < E2 < \cdots < En \quad (5)'$$

In this case, if a ratio of the elastic modulus (En/E1) is too large, the strength in the inner layer is lowered. On the contrary, if it is too small, the strength in the outer layer tends to be lowered. Although not being particularly limited, it is desirable that the ratio (En/E1) of the elastic modulus is preferably equal to or more than 1.50, more preferably equal to or more than 1.75, further preferably equal to or more than 2.0, and particularly preferably equal to or more than 2.25, and it is desirable that an upper limit thereof is preferably equal to or less than 4.0, and more preferably equal to or less than 3.0.

Figure 11:
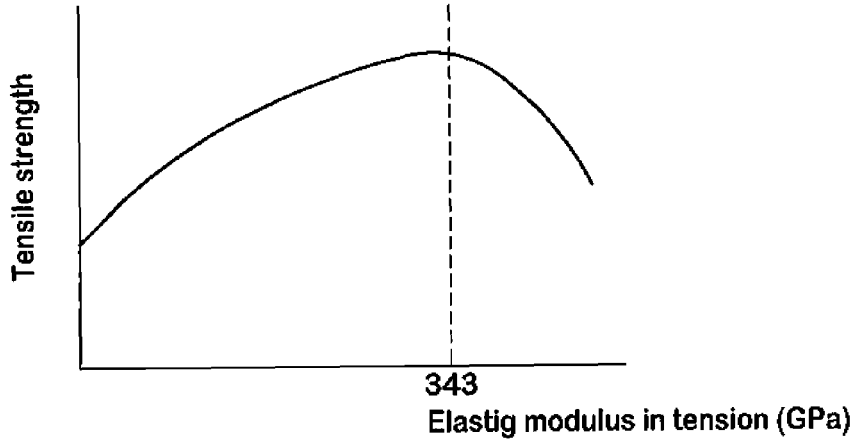
FIG. 11 is a graph showing a relation between a tensile strength and an elastic modulus in tension of a carbon fiber.

In this case, as shown in FIG. 11, in the case of a carbon fiber, if the elastic modulus in tension is more than 343 GPa, there is a tendency that the tensile strength is lowered. Accordingly, it is desirable that the elastic modulus of the fiber f is preferably smaller than 343 GPa. In the case that the elastic modulus in tension is smaller than 343 GPa, the tensile strength of the carbon fiber f is improved approximately in accordance with an increase of the elastic modulus in tension. Therefore, it is desirable that a lower limit of the elastic modulus in tension of the fiber f is preferably equal to or more than 196 GPa, more preferably equal to or more than 245 GPa, and further preferably equal to or more than 294 GPa.

The compressive strength, the tensile strength and the elastic modulus in tension of the fiber mentioned above can be appropriately set by differentiating a fiber material, a filament diameter, a twisting method, a structure of the toe (bundle) and the like.

Figure 12A:
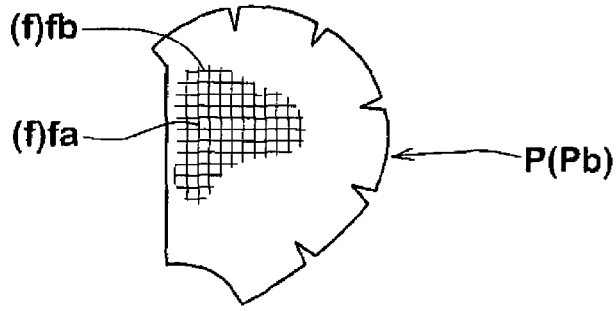
FIGS. 12(A) to 12(E) are plan views of a prepreg.
Figure 12B:
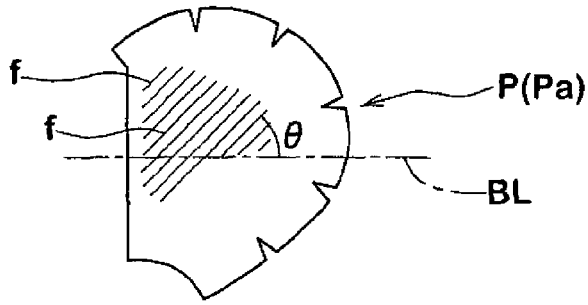
Figure 12C:
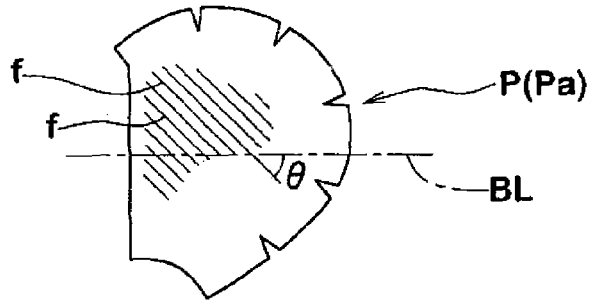
Figure 12D:
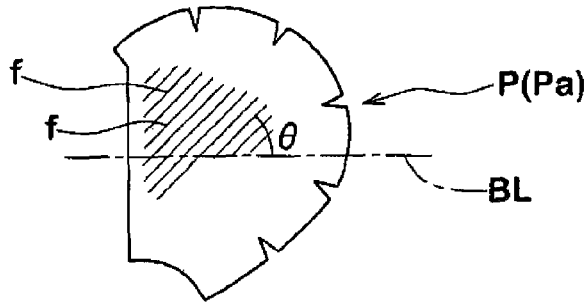
Figure 12E:
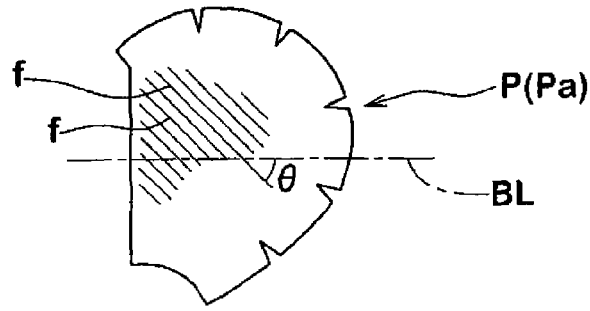
Figure 13A:
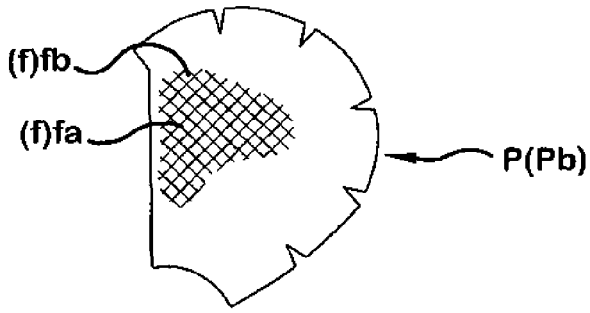
FIGS. 13(A) to 13(E) are plan views of a prepreg showing another embodiment.
Figure 13B:
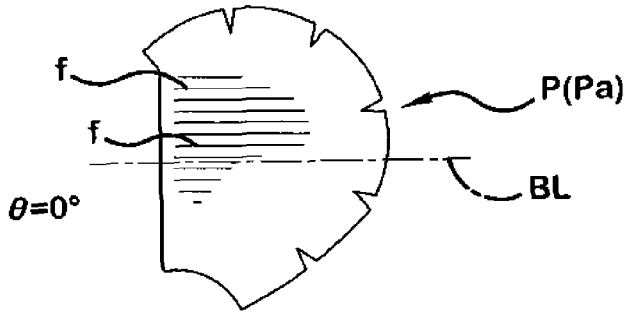
Figure 13C:
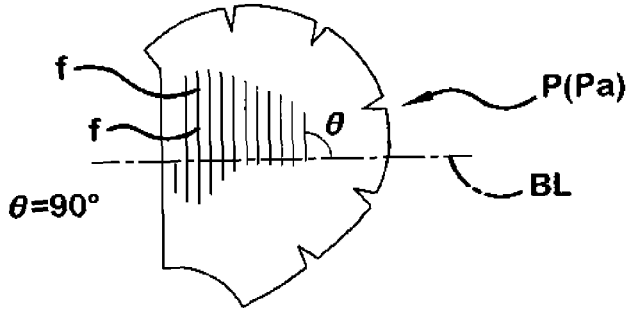
Figure 13D:
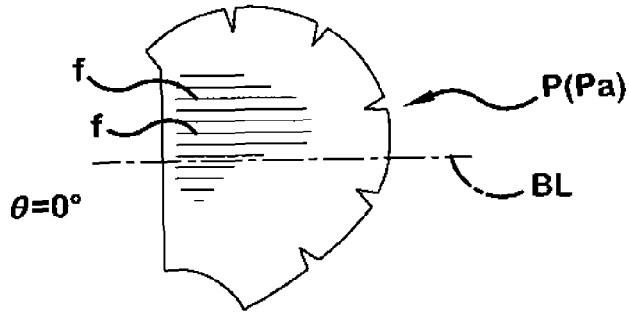
Figure 13E:
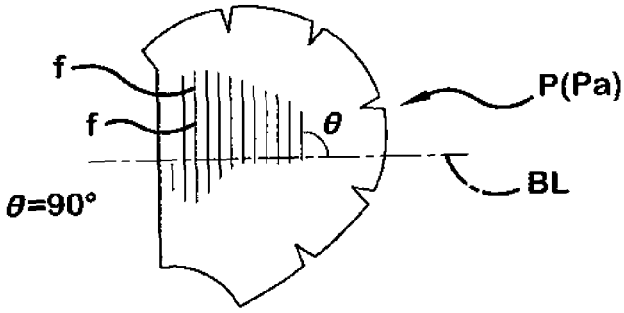

Further, each of the one-way fiber reinforced resin layers L1 to L4 can be formed by a sheet-like one-way prepreg Pa bound by orienting the fiber f in one direction in an uncured matrix resin R, as shown in FIGS. 12(B) to 12)(E). The one-way prepreg Pa has an array body of the fiber f oriented only in one direction. In this example, the angle θ of the fiber f is sequentially set to +45 degrees, −45 degrees, +45 degrees and −45 degrees from the outer side. Each of the one-way prepregs Pa is worked in an outline having a predetermined shape in correspondence to a shape of an opening portion O in the head main body M, as shown in FIGS. 12(B) to 12(E), and the angle θ of orientation of the fiber f with respect to the base line BL in the head longitudinal direction is set as mentioned above at that time. Further, the fiber intersection lamination portion 8 can be formed by applying a heat and a pressure to the prepreg laminated body in which the one-way prepreg Pa is overlapped.

In the same manner, the intersection fiber reinforced resin layer L5 constituting the fiber woven portion 9 can be structured by at least one cross prepreg Pb as shown in FIG. 12(A). The cross prepreg Pb includes fibers fa and fb which are oriented in two directions in one sheet so as to intersect with each other, and these fibers are previously woven in a woven fabric shape. In the cross prepreg Pb mentioned above, it is possible to inhibit the fiber from being disassembled at a forming time when the heat and the pressure are applied, and a uniform elongation can be easily obtained. As a result, employing it in the outermost layer of the resin member FR1 as mentioned above serves for preventing a defective molding such as a wrinkle and a bending.

The outline shape of each of the prepregs P can be appropriately set in correspondence to the shapes of the opening portion O and each of the receiving portions 10*b* and 11*b*. In this example, there is exemplified the structure in which a plurality of slits are provided for bending a peripheral edge in the side portion side of each of the prepregs P so as to easily form the trailing portion 13.

Further, the resin member FR1 in the crown side can be formed in accordance with various methods. For example, as shown in FIGS. 12(A) to 12(E), the laminated body formed by overlapping a plurality of prepregs P can be formed in a desired shape by applying predetermined temperature and pressure. The formed resin member FR1 in the crown side can be firmly fixed to the crown receiving portion 10*b* and the side receiving portion 11*b* of the head main body M, for example, by using an adhesive agent.

Further, the resin member FR1 in the crown side can be formed in accordance with an internal pressure molding method. In accordance with the internal pressure molding method, a head base body 1A is prepared first by attaching a laminated body Ps of the prepreg P to the opening portion O of the head main body M. The head base body 1A is put in a metal mold 20, for example, constituted by an upper mold 20*a* and a lower mold 20*b* which can be separable. The head main body M is previously provided with a through hole 23 communicating with the hollow portion i in the side portion 6 or the like, and an expandable and shrinkable bladder C is inserted therefrom. At this time, it is desirable to previously apply a thermosetting type adhesive agent, a primer and the like between the laminated body Ps of the prepreg and each of the receiving portions 10*b* and 11*b*.

Figure 14A:
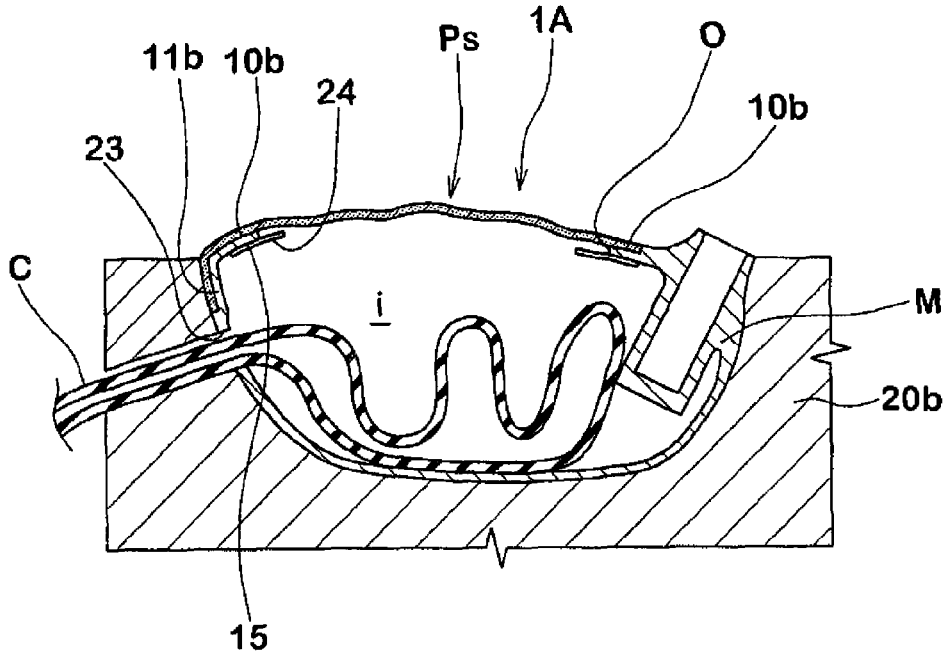
FIGS. 14(A) and 14(B) are cross sectional views describing an internal pressure molding method.
Figure 14B:
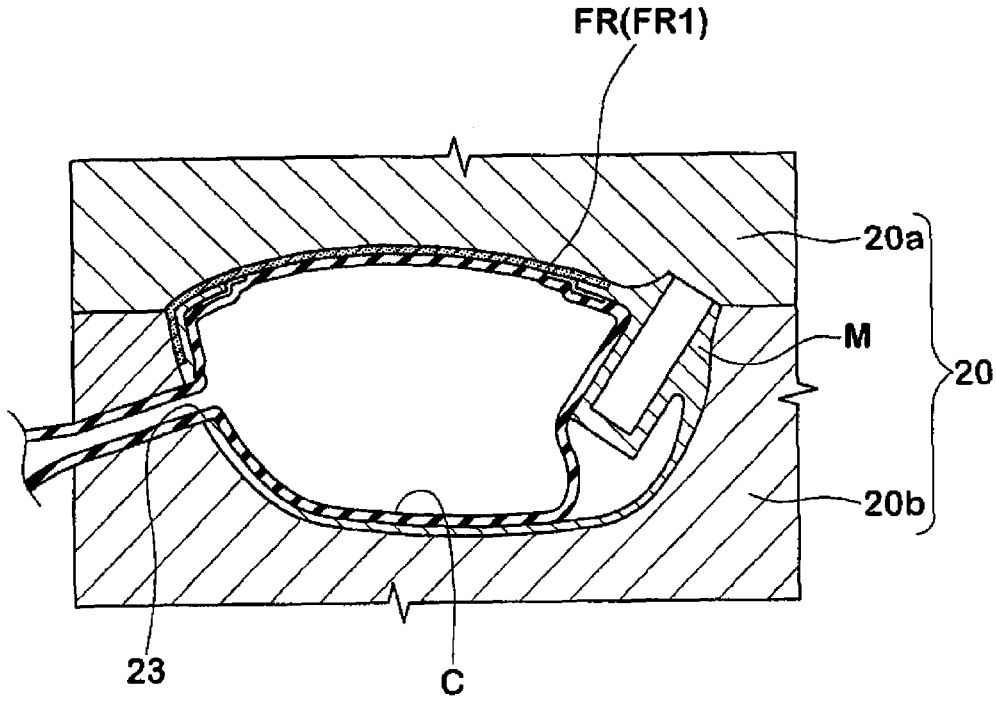

Thereafter, as shown in FIG. 14(B), the metal mold 20 is closed and heated, and the bladder C is expanded and deformed in the hollow portion i. Accordingly, the laminated body Ps of the prepreg exposed to the heat and the pressure from the bladder C is formed as the resin member FR1 in the crown side having a predetermined shape along a cavity of the upper mold 20*a*, and is integrally bonded to each of the receiving portions 10*b* and 11*b*. After molding, the bladder C is deflated, and is taken out from the through hole 23. Further, the through hole 23 is appropriately closed by a cover or the like.

Figure 15:
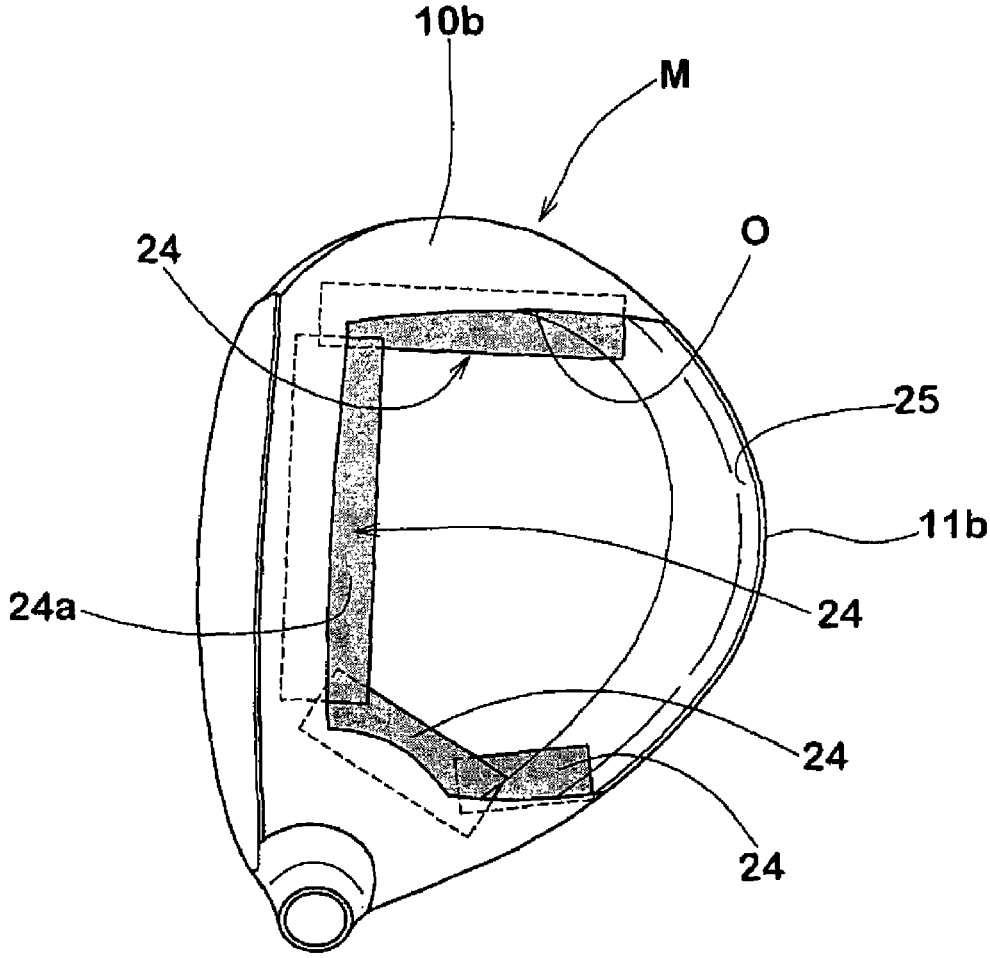
FIG. 15 is a partial cross sectional view showing another embodiment of the internal pressure molding method.

Further, in the case of using the internal pressure molding method, for example, as shown in FIG. 15, it is desirable to previously attach an auxiliary prepreg 24 to an inner surface 25 directed to the hollow portion side of the crown receiving portion 10*b* and/or the side receiving portion 11*b* (in the example shown in FIG. 15, the auxiliary prepreg 24 is not illustrated in the side receiving portion 11*b*). The auxiliary prepreg 24 is firmly fixed so as to have a protruding portion 24*a* protruding from an edge of the opening portion O to the opening portion O side. Further, it is desirable that the auxiliary prepreg 24 is separated in a tape shape as illustrated, or is formed in a ring shape (not shown), thereby improving an attaching operability to the inner surface of the head main body.

Accordingly, as shown in FIG. 3, the peripheral edge portion of the resin member FR can be formed as a fork shape pinching each of the receiving portions 10*b* and 11*b*, in particular, a fork portion 26 having an outer piece portion 26*a* extending along an outer surface side of the head main body M and an inner piece portion 26*b* extending along an inner surface side thereof. As mentioned above, it is possible to form the fork portion 26 in the peripheral edge portion of the resin member FR1 in the crown side in accordance with a simple procedure, and it is possible to obtain a physical engaging effect of the head main body M and the resin member FR so as to improve a bonding strength, by including a step of previously arranging the auxiliary prepreg sheet 24 having the protruding portion 24*a* in the inner surface side of the receiving portion 10*b* or 11*b* at the time of manufacturing the head 1.

It is more effective that the head 1 in accordance with the present embodiment is applied to a head volume equal to or more than 200 $cm^3$, more preferably equal to or more than 300 $cm^3$, and further preferably equal to or more than 350 $cm^3$. If the head volume is less than 200 $cm^3$, a moment of inertia is reduced, and a sweet spot area is reduced. On the other hand, if the head volume is too large, the weight is increased and the height of the sweet spot SS becomes equal to or more than 38 mm, so that the ball tends to be hit with backspin and at a low flying angle. It is desirable that the head volume is preferably equal to or less than 500 $cm^3$, more preferably equal to or less than 480 $cm^3$, and further preferably equal to or less than 470 $cm^3$.

The description is given above of the embodiment in accordance with the present invention, however, the present invention is not limited to the embodiment mentioned above, and can be applied, for example, to an iron type golf club head and a utility type golf club head having a hollow structure, and further to a putter type golf club head. Further, in the embodiment mentioned above, there is shown the structure in which the resin member constituted by the fiber reinforced resin is constituted by the resin member FR1 in the crown side, however, it goes without saying that the resin member may be arranged, for example, in the side portion and the sole portion. Further, the thickness of each of the resin member FR, the head main body M and the like can be appropriately determined in accordance with general rule.

In order to confirm the effect of the present invention, a wood type driver head having the head volume of 430 $cm^3$ is manufactured by way of trial on the basis of the specification in Table 1. A shape and the specification of the head main body and the resin member are shown in FIGS. 1 to 5 and the following description.

Head Main Body

Material: Ti-6Al-4V

Manufacturing method: integral molding in accordance with a lost wax precise casting method Resin Member in Crown Side Manufacturing method: internal pressure forming method Number of used prepreg: five The fiber intersection lamination portion uses four one-way prepregs and an angle of orientation of the fiber is shown in Table.

The fiber woven portion uses one plain woven cross prepreg. The angle of orientation of the fiber is set to 0 degrees and 90 degrees in the example in Table 1 and set to ±45 degrees in the example in Table 2.

Fiber material: carbon fiber

Elastic modulus in tension of fiber: 240.3 GPa

Thickness of resin member in crown side after being formed: about 0.8 to 0.9 mm

Base resin of matrix resin: epoxy resin

Repulsing performance and durability are tested with respect to each of the trial heads manufactured on the basis of the specification mentioned above. The methods therefor are as follows.

Repulsing Performance

The repulsing performance of the head is measured in accordance with Procedure for Measuring the Velocity Ratio of a Club Head for Conformance to Rule 4-le, Revision 2 (Feb. 8, 1999) of U.S.G.A. The larger the numeric value is, the better the performance is.

Durability

A 45 inch wood type club is manufactured by way of trial by attaching each of the trial heads to a carbon shaft MP-200 (Flex R) manufactured by SRI Sports Ltd., and is attached to a swing robot (Short Robo IV) manufactured by MIYAMAE CO., LTD., thereby hitting the golf ball at a head speed of 51 m/s and a face center position. The number of the balls until the head is broken is measured. Results of test are shown in Table 1 and Table 2.

TABLE 1

| | Specification of prepreg | Example 1 FIG. 12 | Example 2 FIG. 12 | Example 3 Based on FIG. 12 | Comparative Example 1 FIG. 12 | Comparative Example 2 FIG. 12 | Comparative Example 4 FIG. 12 |
|---|---|---|---|---|---|---|---|
| Innermost layer | Angle of orientation of fiber θ [deg] | 45 | 45 | 45 | 45 | 45 | 45 |
| | Compressive strength σc1 [GPa] | 1.6 | 1.6 | 1.6 | 1.0 | 1.0 | 1.6 |
| | Tensile strength σt1 [GPa] | 2.0 | 2.0 | 2.0 | 6.0 | 6.0 | 2.0 |
| | Elastic modulus in tension [GPa] | 98 | 98 | 98 | 343 | 343 | 98 |
| Second layer from inner side | Angle of orientation of fiber θ [deg] | −45 | −45 | −45 | −45 | −45 | −45 |
| | Compressive strength σc1 [GPa] | 1.3 | 1.0 | 1.5 | 1.1 | 1.0 | 1.6 |
| | Tensile strength σt1 [GPa] | 3.0 | 2.0 | 3.0 | 4.0 | 6.0 | 2.0 |
| | Elastic modulus in tension [GPa] | 147 | 98 | 127 | 245 | 343 | 98 |
| Third layer from inner side | Angle of orientation of fiber θ [deg] | 45 | 45 | 45 | 45 | 45 | 45 |
| | Compressive strength σc1 [GPa] | 1.1 | 1.0 | 1.4 | 1.3 | 1.0 | 1.6 |
| | Tensile strength σt1 [GPa] | 4.0 | 2.0 | 4.0 | 3.0 | 6.0 | 2.0 |
| | Elastic modulus in tension [GPa] | 245 | 98 | 147 | 147 | 343 | 98 |
| Fourth layer from inner side | Angle of orientation of fiber θ [deg] | −45 | −45 | −45 | −45 | −45 | −45 |
| | Compressive strength σc1 [GPa] | 1.0 | 1.0 | 1.3 | 1.6 | 1.0 | 1.6 |
| | Tensile strength σt1 [GPa] | 6.0 | 6.0 | 4.5 | 2.0 | 6.0 | 2.0 |
| | Elastic modulus in tension [GPa] | 343 | 98 | 196 | 98 | 343 | 98 |
| Fifth layer from inner side | Angle of orientation of fiber θ [deg] | None | None | 45 | None | None | None |
| | Compressive strength σc1 [GPa] | | | 1.2 | | | |
| | Tensile strength σt1 [GPa] | | | 5.0 | | | |
| | Elastic modulus in tension [GPa] | | | 245 | | | |
| Sixth layer from inner side | Angle of orientation of fiber θ [deg] | None | None | −45 | None | None | None |
| | Compressive strength σc1 [GPa] | | | 1.1 | | | |
| | Tensile strength σt1 [GPa] | | | 5.5 | | | |
| | Elastic modulus in tension [GPa] | | | 294 | | | |
| Seventh layer from inner side | Angle of orientation of fiber θ [deg] | None | None | 45 | None | None | None |
| | Compressive strength σc1 [GPa] | | | 1.0 | | | |
| | Tensile strength σt1 [GPa] | | | 6.0 | | | |
| | Elastic modulus in tension [GPa] | | | 343 | | | |
| Results of test | Coefficient of restitution | 0.839 | 0.838 | 0.839 | 0.839 | 0.839 | 0.838 |
| | Durability | 6720 | 5714 | 7121 | 1910 | 2659 | 3331 |
| | Sweet spot height [mm] | 33.0 | 33.0 | 34.8 | 33.0 | 33.0 | 33.0 |

TABLE 2

| | Specification of prepreg | Example 5 FIG. 13 | Example 6 FIG. 13 | Example 7 Based on FIG. 13 | Comparative Example 3 FIG. 13 | Comparative Example 4 FIG. 13 | Comparative Example 8 FIG. 13 |
|---|---|---|---|---|---|---|---|
| Innermost layer | Angle of orientation of fiber θ [deg] | 90 | 90 | 90 | 90 | 90 | 90 |
| | Compressive strength σc1 [GPa] | 1.6 | 1.6 | 1.6 | 1.0 | 1.0 | 1.6 |
| | Tensile strength σt1 [GPa] | 2.0 | 2.0 | 2.0 | 6.0 | 6.0 | 2.0 |
| | Elastic modulus in tension [GPa] | 98 | 98 | 98 | 343 | 343 | 98 |
| Second layer from inner side | Angle of orientation of fiber θ [deg] | 0 | 0 | 0 | 0 | 0 | 0 |
| | Compressive strength σc1 [GPa] | 1.3 | 1.0 | 1.5 | 1.1 | 1.0 | 1.6 |
| | Tensile strength σt1 [GPa] | 3.0 | 2.0 | 3.0 | 4.0 | 6.0 | 2.0 |
| | Elastic modulus in tension [GPa] | 147 | 98 | 127 | 245 | 343 | 98 |
| Third layer from inner side | Angle of orientation of fiber θ [deg] | 90 | 90 | 90 | 90 | 90 | 90 |
| | Compressivestrength σc1 [GPa] | 1.1 | 1.0 | 1.4 | 1.3 | 1.0 | 1.6 |
| | Tensile strength σt1 [GPa] | 4.0 | 2.0 | 4.0 | 3.0 | 6.0 | 2.0 |
| | Elastic modulus in tension [GPa] | 245 | 98 | 147 | 147 | 343 | 98 |
| Fourth layer from inner side | Angle oforientation of fiber θ [deg] | 0 | 0 | 0 | 0 | 0 | 0 |
| | Compressive strength σc1 [GPa] | 1.0 | 1.0 | 1.3 | 1.6 | 1.0 | 1.6 |
| | Tensile strength σt1 [GPa] | 6.0 | 6.0 | 4.5 | 2.0 | 6.0 | 2.0 |
| | Elastic modulus in tension [GPa] | 343 | 98 | 196 | 98 | 343 | 98 |
| Fifth layer from inner side | Angle of orientation of fiber θ [deg] | None | None | 90 | None | None | None |
| | Compressive strength σc1 [GPa] | | | 1.2 | | | |
| | Tensile strength σt1 [GPa] | | | 5.0 | | | |
| | Elastic modulus in tension [GPa] | | | 245 | | | |
| Sixth layer from inner side | Angle of orientation of fiber θ [deg] | None | None | 0 | None | None | None |
| | Compressive strength σc1 [GPa] | | | 1.1 | | | |
| | Tensile strength σt1 [GPa] | | | 5.5 | | | |
| | Elastic modulus in tension [GPa] | | | 294 | | | |
| Seventh layer from inner side | Angle of orientation of fiber θ [deg] | None | None | 90 | None | None | None |
| | Compressive strength σc1 [GPa] | | | 1.0 | | | |
| | Tensile strength σt1 [GPa] | | | 6.0 | | | |
| | Elastic modulus in tension [GPa] | | | 343 | | | |
| Results of test | Coefficient of restitution | 0.841 | 0.840 | 0.841 | 0.840 | 0.841 | 0.839 |
| | Durability | 6500 | 5850 | 7215 | 1820 | 2704 | 3127 |
| | Sweet spot height [mm] | 33.0 | 33.0 | 34.8 | 33.0 | 33.0 | 33.0 |

As a result of the tests, it is possible to confirm that the golf club head in accordance with the embodiment improves the durability without changing the sweet spot height or the like. Further, there is no significant reduction of the repulsing performance.

What is claimed is:

1. A method for producing a golf club head in which at least a part of a crown portion forming an upper surface of the head is formed by a resin member made of a fiber reinforced resin containing a fiber oriented in a matrix resin, and the resin member includes a fiber intersection lamination portion where one-way fiber reinforced resin layers are laminated, in which the fiber in each of said one-way fiber reinforced resin layers is oriented in one direction, and the fibers of adjacent two one-way fiber reinforced resin layers are oriented in a different direction from each other, Said method comprising the steps of:

attaching a laminated body of prepregs to an opening portion of a head main body made of a metal material and having the opening portion at least in the crown portion and a through hole communicating with a hollow portion, thereby providing a head base body having a hollow inner portion, placing a head base body in a separable mold comprising an upper mold and a lower mold, inserting an expandable and shrinkable bladder into the hollow portion through the trough hole, closing and heating the mold, while expanding the bladder in the hollow portion, thereby exposing the laminated body of prepregs to a heat and pressure from the bladder and forming it as the resin member having a predetermined shape along a cavity of the upper mold, While integrally bonding the resin member to crown and side receiving portions of the head base body, attaching, prior to attaching said laminated body of prepregs to the opening portion, at least one piece of an auxiliary prepreg to an inner surface facing a hollow portion side of said crown and side receiving portions so as to have a protruding portion protruding from an edge of the opening portion toward an opening portion side, and deflating the bladder and removing the bladder via the through hole.

2. The method of claim 1, wherein said auxiliary prepreg is in a tape-like shape or in a ring-like shape.

* * * * *